United States Patent [19]

Strandell

[11] 4,392,370

[45] Jul. 12, 1983

[54] TWO-HIGH ROLLING STAND FOR BAR AND/OR WIRE ROLLING MILL

[76] Inventor: Per-Olof Strandell, Bockstigen 3, 183 51 Täby, Sweden

[21] Appl. No.: 198,593

[22] Filed: Oct. 20, 1980

[30] Foreign Application Priority Data

Oct. 23, 1979 [SE] Sweden ..... 7908779

[51] Int. Cl.[3] ..... B21B 31/02

[52] U.S. Cl. ..... 72/201; 72/235; 72/244

[58] Field of Search ..... 72/201, 221, 237, 244, 72/234, 235

[56] References Cited

U.S. PATENT DOCUMENTS

| | | | |
|---|---|---|---|
| 679,413 | 7/1901 | Bunker | 72/244 |
| 3,153,954 | 10/1964 | Blair | 72/221 |
| 3,572,079 | 3/1971 | Bond | 72/244 |
| 4,366,694 | 1/1983 | Pariseau | 72/235 |

FOREIGN PATENT DOCUMENTS 2216011 10/1973 Fed. Rep. of Germany .

*Primary Examiner*—Lowell A. Larson

*Attorney, Agent, or Firm*—LeBlanc, Nolan, Shur & Nies

[57] ABSTRACT

A two-high rolling stand (1) for bar and/or wire rolling mill. The rolling stand (1) is characterized in that a roll package, which substantially comprises a pair of rolls (13) with their axial directions in parallel and necessary bearing devices (14) with bearings and bearing housings for supporting said rolls (13), is located between two side plates (16) or the like, which are in parallel with each other, and of which each plate (16) is arranged with its main extension plane (17) substantially in parallel with a plane through the centre lines of the rolls (13). The roll pair further is characterized in that the side plates (16) on opposed sides of said roll package are arranged to take up roll forces via two end members (18), and that the roll package is arranged so as directly and/or indirectly to rest against the end members (18).

A further characterizing feature is that said end members (18) are arranged so as to permit adjustment of the roll distance, so-called roll gap adjustment.

13 Claims, 6 Drawing Figures

TWO-HIGH ROLLING STAND FOR BAR AND/OR WIRE ROLLING MILL

Figure 1:
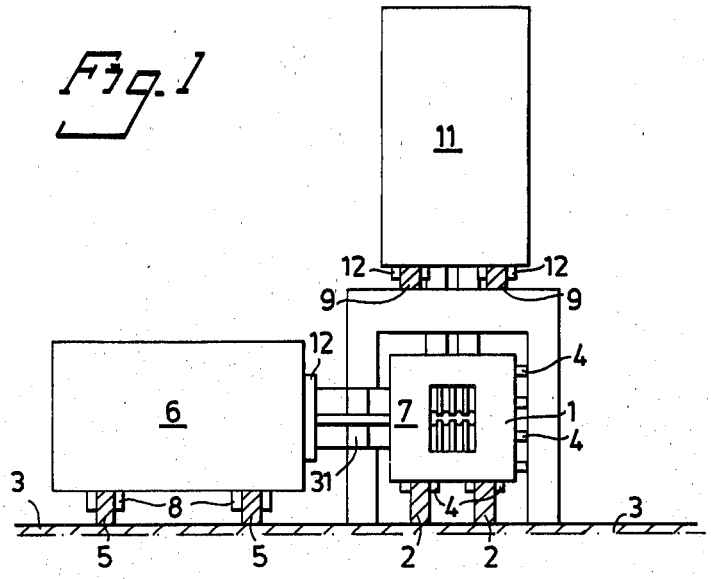

This invention relates to a two-high rolling stand for bar and/or wire hot rolling mills. The mill is intended to comprise a number of two-high rolling stands arranged one after the other in a substantially straight line in a so-called continuous train. Each rolling stand, thus, includes one pair of rolls. Hot-rolled bars and wires are in the form of various products, for example round bars, square bars, angles and the like. The products manufactured, rolled, in the mill constitute a so-called manufacturing or product program, which often varies from one mill to another and often also in time for a definite mill.

At hot rolling of bars and wires a so-called billet is passed through a number of roll pairs, which can be arranged in different ways, and is thereby successively subjected to cross-section reduction. When rolling in a train, often a number of rolling stands are arranged in a substantially straight line one after the other at a relatively great distance between each rolling stand. The distance is determined by the requirement of maintaining the billet free of tension between the stands, which is achieved by causing the billet to form a loop of greater or smaller width. The loop also is utilized for controlling the rotation speed in the different rolling stands where the speed is controlled by the loop form. Rolling also is carried out straight through, without loop, in which case a certain tensile stress in the billet between the stands cannot be avoided. At definite conditions in general, this stress gives rise to a reduced width increase of the billet and to an increased area reduction at the passage through a roll pair. The billet ends, because of their rolling without tension, therefore will be coarser, which may necessitate scrapping.

An alternative technique is to arrange the stands relatively tightly spaced and to roll straight through, with tensile stresses in the billet between the rolling stands. In this case the billet ends, which have coarser dimensions than the main part of the billet, are very short and thereby reduce the amount of possible scrapping. At these relatively tightly arranged rolling trains, however, a certain distance between the stands is maintained for providing necessary accessibility. Both these said rolling methods have advantages and disadvantages, implying that one method is advantageous at certain rolling, and the other method at other rolling. However, when the rolling mill has been erected and mounted, and the distances between the rolling stands have been fixed, the rolling method is prescribed.

In wire rolling mills operating with high finishing rolling speeds now so-called roll blocks are used as finishing trains, in which blocks a number of rolling stands, from two to ten, are assembled to form one unit and are driven in common by one motor. At most of the constructions, roll rings and bearing on free journal are used, which implies that the rolling stock at a fault can be thrown out of the mill. This method of supporting the rolls, however, has obvious disadvantages from a strength point of view. By supporting the rolls on two journals, a structure can be obtained which is more rigid and improved from a bearing aspect. One disadvantage, however, is that the stock passing through the mill is enclosed in each stand by a frame, the roll stand. At faulty operation, for example when the stock is not caught by a pair or cut off between two stands, the stock rushing on is baked together in the structure and causes damages. For this reason, an amply dimensioned distance between the pairs is required.

As has become apparent from the aforesaid, bar products usually are hot-rolled in two-high rolling stands, i.e. between two rolls. The rolls generally are provided with grooves.

At the rolling, the stock is worked against two opposed sides when being passed through a roll pair. The working direction, however, is changed after definite sequences. For a flat stock, for example, flat sides and edge sides are worked alternatingly. This method is similar for all sectional shapes, but the sequence is different. At rolling, for example, with alternating horizontal and vertical roll pairs, the most favourable number of horizontal and, respectively, vertical pairs is different for different sections, and also the sequence is different.

In a rolling train conventionally a definite number of horizontal and, respectively, vertical stands are arranged. The choice depends on the predetermined product program to be rolled. The choice of sequences then is final. There exist solutions, however, at which the stands can be turned, or the drive can be arranged so as to influence the sequence. These solutions, however, are relatively clumsy and especially expensive. As they also require relatively much space, the distances between the rolling stands are great.

At the rolling of sectional steel, for example angles, a relatively great number of different grooves and roll pair passages are required for re-shaping the stock cross section, which normally is square. The great number is due to the fact that reduction of cross-sectional area per mass is relatively limited, for rolling as well as working-technical reasons, because at a pass between a roll pair an increase in width is obtained which decreases the area reduction. Furthermore, the area reduction in different parts of the cross-section must be maintained relatively constant relative to each other, which restricts the permissible area reduction. These problems can be decreased by rolling with tension in the stock between the rolling stands, which tension a.o. reduces the increase in width and the energy demand. This solution, however, presupposes a tight rolling stand arrangement. It is, thus, possible by means of tension between the stands to control and increase the area reduction.

Conventional rolling mills for the object here in question, thus, as pointed out above have essential shortcomings and deficiencies. Substantial advantages are achieved by a rolling mill, for example according to the Swedish Pat. No. 2216011 (patent application No. 7908780-5), which is flexible and adjustale, and at which the rolling stands upon demand can be positioned tightly together without disadvantage, and the rolling sequence can be varied within wide limits. The present invention relates to two-high rolling stands adapted for such a flexible and adjustable rolling mill. One characterizing feature of rolling stands according to the invention is the small extension or thickness in the rolling direction which, thus, permits a tight arrangement.

Conventional rolling stands are constructed so that each roll is mounted on two journals with bearings built-in in bearing housings. The housings are mounted in a so-called roll stand. A structure of this kind has a substantial thickness in the rolling direction which normally is at least three times the diameter of the rolls. Modern so-called standless rolling stands also have about the same dimension in thickness direction.

By rolling sectional steel with tension between the rolling stands, the possible area reduction per pass is increased and the necessary number of grooves is decreased. The number of grooves per roll, therefore, can be limited to two, for example, which is considerably lower number than used at present. Rolling stands according to the present invention are adapted to be moved at groove change between two or more fixed positions in order to maintain a substantially straight rolling line.

The present invention, thus, relates to two-high rolling stands for bar and/or wire rolling mills.

The invention is characterized in that a roll package, comprising substantially a pair of rolls with their axial direction in parallel and necessary bearing means with bearings and housings for mounting said rolls, is located between two side plates or corresponding members substantially in parallel relative to each other, each plate located with its main extension plane substantially in parallel with a plane through the centre lines of the rolls, said side plates on opposite sides of said roll package being capable to take up roll forces via two end members, and that said roll package is arranged so as directly and/or indirectly to rest against said end members, and said end members are capable to permit adjustment of the roll distance, so-called roll gap.

The invention is described in greater detail in the following, with reference to the accompanying drawings, in which FIG. 1 is a schematic view of a rolling mill seen in the intended rolling direction where the rolling stands are a preferred embodiment of the present invention.

Figure 2:
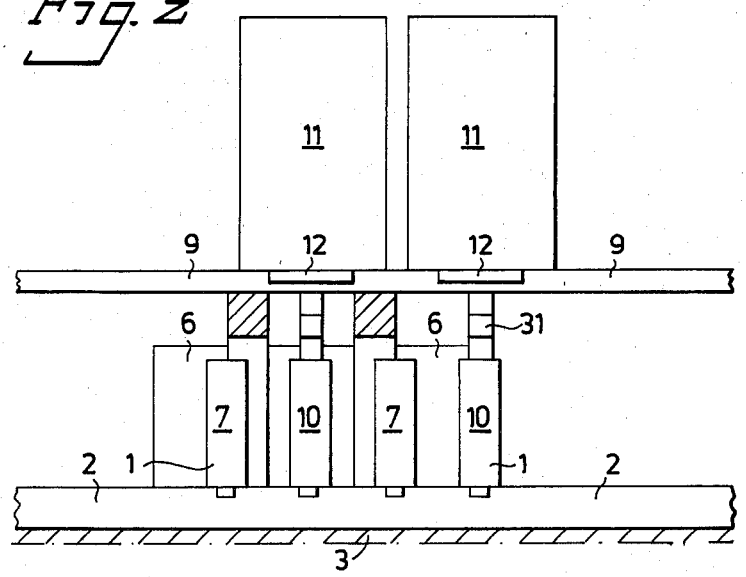
Figure 3:
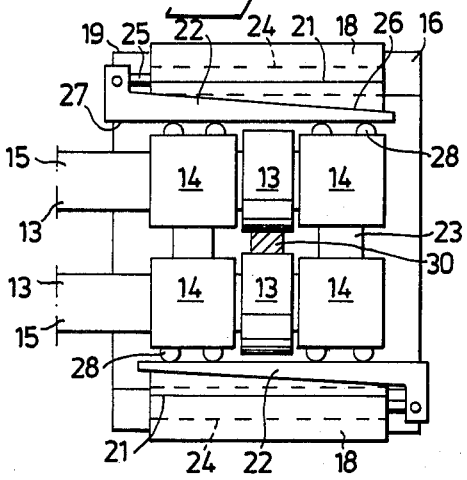
Figure 4:
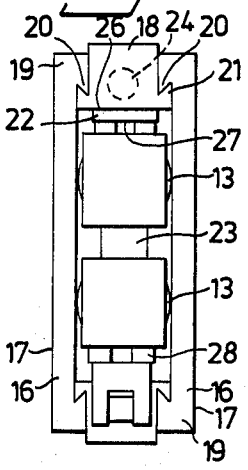
Figure 5:
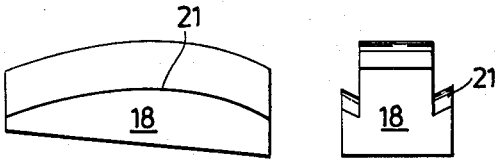
Figure 6:
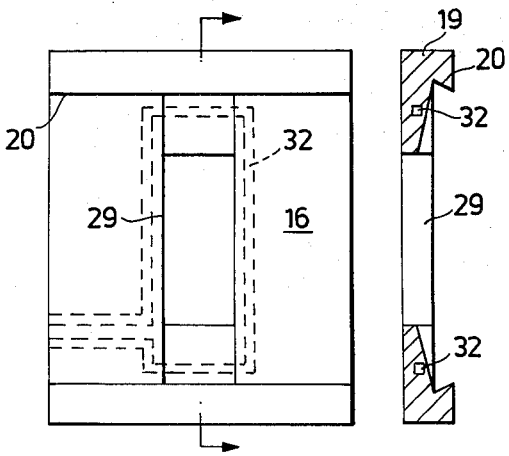

FIG. 2 is a view of the rolling mill seen from the right in FIG. 1,

FIG. 3 shows in greater detail but still schematically a preferred embodiment of a rolling stand according to the present invention where the rolling stand is seen in the rolling direction and the left-hand side plate is removed, FIG. 4 is a view of the rolling stand from the right in FIG. 3, FIG. 5 shows an end member according to the invention, and FIG. 6 shows a side plate according to the invention.

In FIG. 1, the numeral 1 designates a preferred embodiment of two-high rolling stands according to the present invention, where the rolling stands are parts of a rolling mill according to the Swedish Pat. No. 2216011 (Swedish patent appln. No. 7908780-5). The rolling stands 1, seen from the right, left, from above or below in FIG. 1, have a substantially rectangular or rectangular-like cross-section, and perpendicularly to the rolling direction they have an almost square or square-like cross-section, as schematically shown in FIGS. 1 and 2, or a cross-section being substantially symmetric in another way.

The rolling stands 1 are arranged so, that the width of the rectangular cross-section is very small, which implies that the width in the rolling direction is only slightly greater than or equal to the diameter of the rolls. The rolling stand structural design according to the invention is described in greater detail with reference to FIGS. 3–6.

The rolling stands 1 are arranged to be movably positioned one after the other on one or more straight guide bars 2 or the like, which are rigidly secured in connection to a foundation 3 or suitable support 3. The rolling stands 1 thus, can be positioned in optional spaced relationship and also tightly together, owing to the small width in the rolling direction. The rolling stands are intended to be fixed in desired positions on said bars 2 by means 4 which, for example, are hydraulic and simply and easily can be released. Said means 4 are only indicated in FIGS. 1 and 2.

Due to their said square or similarly symmetric configuration, the rolling stands 1 can be arranged for being used either as horizontal or as vertical rolling stands. The method of use is changed simply by a turning in a plane perpendicular to the rolling direction.

In parallel with the bars 2 for the rolling stands 1, one or more guide bars 5 or the like are provided on the foundation 3, on which bars 5 drive means 6 consisting of motors and preferably directly coupled gears for horizontal rolling stands are movably located. The said drive means are intended to be fixed on the bars 5 in desired positions, which are suitable in relation to the rolling stands 7, by devices 8 indicated in FIGS. 1 and 2, which devices are, for example, hydraulic and simply and rapidly released.

Above, as shown in FIGS. 1 and 2, or beneath the bars 2 for the rolling stands, guide bars 9 or the like are provided for drive means 11 for vertical stands 10, which drive means are movable and can be fixed by devices 12 in a manner corresponding to that of the horizontal stands. The drive means 11, however, preferably are arranged vertically, as shown in FIGS. 1 and 2.

The drive means 6 and 11 are of equal design, so that they can be used for driving both horizontal and vertical stands and for this purpose be mounted on the bars 5 and, respectively, 9.

In FIGS. 1 and 2 an arrangement with four rolling stands, alternatingly horizontal and vertical, is shown. More rolling stands, of course, can be arranged in a corresponding manner.

The design of rolling stands, drive means and of the means for mounting rolling stands and drive means described above render it possible to choose the desired rolling sequence as it is demanded. Each stand is turned and fixed so that the desired sequence with respect to horizontal and vertical rolling stands is obtained. The drive means 6,11, further, are moved so as to be adapted for the desired sequence. The number of driving means for horizontal stands and, respectively, vertical stands thus, is adjusted to the desired sequence by movement between the guide bars 5 and, respectively, 9.

As has become apparent from the aforesaid, also the distances between the rolling stands can be selected so as to be adapted for the production in question. When rolling a dimension and a cross-sectional shape desired to be rolled with loops between the rolling stands, the stands are moved apart to a suitable extent, and when rolling products desired to be rolled without loops, the pairs are moved together. In a rolling mill of the type described above, the rolling stands further can be packed together very closely. Inspection and manual operation easily can be made after the stands have been moved apart. Also rolling stand changes can be carried out rapidly in such a rolling mill. This means shorter waste times and higher effective capacity compared with conventional rolling mills.

The rolling mill further offers the advantage that part of the rolling can take place with tension between the stands in tightly packed arrangement while, for example, rolling in the finishing stand or the two finishing stands can be carried out without tension at a great distance between the stands.

The rolling mill also can be designed so that the drive means are are coupled together mechanically to one roll block, which has essential advantages over conventional roll blocks. As a result, a rigid construction with improved bearing of the rolls is obtained, and at breakdowns or for adjustment the block can rapidly be divided between desired rolling stands.

In FIG. 3 the numeral 13 designates rolls, which are two in number and arranged with their axial directions, roll axles, in parallel. The numeral 14 designates bearing devices comprising necessary bearing housings and bearings for said rolls. The rolls 13 and the bearing devices 14 together constitute a roll package. For being coupled to the drive equipment, each roll 13 is provided with a journal 15. The journals 15 are directed in the same direction when the roll package is mounted in the desired way, as shown in FIGS. 3 and 4.

Said roll package is intended to be positioned between two side plates 16 or corresponding members, where the plates 16 are in parallel with each other, and the main extension plane 17 of each plate 16 is perpendicular to the rolling direction as shown in FIGS. 3 and 4, i.e. in parallel with a plane through the centre lines of the rolls 13.

The side plates 16 are intended to be held together by two end members 18 located on opposite sides of said roll package and substantially between the side plates 16. The roll package here is intended to indirectly and/or directly rest against the end members 18, which are arranged to be coupled to the side plates 16 in a suitable way, so that the roll force, i.e. the force which at rolling tends to press apart the rolls 13, is transferred to and taken up by the side plates 16 via the end members 18.

In FIGS. 3 and 4 subordinate details such as possible lateral pieces, which are intended to be arranged with their main extension plane perpendicularly to the axial directions of the rolls, are not shown, nor are the fixing devices 4 shown.

According to a preferred embodiment, each of two opposed ends 19 of each side plate 16 comprises a longitudinal boss 20 or the like, which are intended to face toward the end members 18 and to abut, rest, against them, for example, via flanges 21 or the like on the end members 18 whereby, thus, the roll force is transferred to be taken up by the plates 16 via the end members 18.

Said bosses 20 and flanges 21 ca be formed straight as shown in FIGS. 3 and 4 and, thus, extend substantially in parallel with the axial direction of the rolls 13. The bosses 20 may also be curve-shaped and, for example, have the form of an arc portion in the main extension plane 17 of the side plates 16, in which case the flanges 21 are formed correspondingly, as shown in FIG. 5.

The bosses 20 and flanges 21, alternatively, can be replaced by double wedges, which act in known manner in opposed grooves in plate 16 and, respectively, end member 18.

Adjustment of the distance between the rolls 13, i.e. roll gap adjustment, according to a preferred embodiment is effected by two wedges 22, one of which is located between each end member 18 and said bearing devices 14 and intended to rest against the end member 18 and bearing device 14.

Each wedge 22 is movable in a suitable way, for example manually or hydraulically, substantially in parallel with the axial directions of the rolls 13. This movement, thus, brings about a well-defined adjustment of the roll gap. Between the bearing devices 14, suitable resilient means 23 are provided and intended to press apart said devices when the wedges 22 are moved corresponding to an increase of the roll gap.

FIGS. 3 and 4 shows schematically a preferred embodiment with respect to moving the wedges 22 hydraulically. Each end member comprises a preferably cylindric bore 24 for a hydraulically operated cylinder, the piston rod 25 of which is arranged so as suitably to actuate the wedge 22 as shown in FIGS. 3 and 4. The cylinder and the medium supply means are not shown in the drawings. The inner wall of the bore 24 proper, of course, can also be the inner wall of the cylinder. The longitudinal direction of the bore 24 and cylinder can be laid in parallel with the axial direction of the rolls 13 as in FIG. 3, or it may form an angle with said direction, if required, in order to prevent unfavourable load at the movement.

The wedges 22 may also be moved manually, for example by a suitable arrangement of wheels and screws.

The wedge surfaces 26,27 intended to abut the end member 18 and, respectively, bearing devices 14 preferably are plane.

According to a preferred embodiment, the plane surface 27 of each of the wedges 22 which faces toward the rolls 13 is intended to abut elevations 28 on said bearing devices 14 which are formed and arranged with such high precision, that the load, which the elevations 28 are to take up, is distributed uniformly both over each elevation and between the elevations.

In FIG. 6 a preferred embodiment of a side plate 16 is shown. The plate 16 includes a recess 29, which permits the passage of hot stock designated in FIG. 3 by 30 in and/or out between the rolls 13. In cases in which very short distances between the rolling stands are required, the recess 29 is arranged of such size and in such a manner, that space is left for the portion of the rolls 13, the roll barrel, on which rolling is effected. In this way the distance between two rolling stands can be reduced to the measure of the roll diameter at the barrel, or slightly smaller.

The rolling stands 7,10 also can be arranged for movement perpendicularly to the rolling direction at said groove changes. The movability preferably is built-in the devices 4, so that a horizontal movement of the horizontal stands is carried out between two end portions in grooves of some kind in the devices 4 or the rolling stand, and a vertical movement of the vertical pairs is carried out by expansion or compression of the devices 4. A number of equivalent solutions can be imagined. The movement in relation to the drive means 6,11 preferably is taken up in a coupling device 31, which in any case is required between roll pair and drive means. A so-called splines-coupling can be suitable, but also here several solutions can be imagined. In principle also a movement of the drive means corresponding to that of the rolling stands is imaginable.

The numeral 32 in FIG. 6 designates a cooling coil, channel or the like, which is located in the side plate 16, preferably in connection to said recess 29 and is intended to be passed through preferably by water. The coil is connected to a feeding device (not shown) for coolant supply. The object is to cool to a necessary extent the heat transferred from the hot stock to the side plate 16, in order to prevent deformation of said plate. Several coils, of course, can be used, and they also may be arranged in a way other than shown schematically in FIG. 6.

The function of rolling stands according to the present invention should be apparent from the above description. At roll change dismantling preferably is carried out by removing a side plate 16, so that the two rolls can be lifted out, or after regrinding, be again positioned.

Rolling stands according to the present invention, thus, imply, as explained above, that the distances between rolling stands in a train or so-called block can be reduced to a small part of the distances applied at conventional constructions.

This short roll distance offers several advantages. With a suitable roll pass design, for example, the sequence flat-edging oval, it is possible at this short roll distance to roll through two to four stands without using so-called guides, which are used to feed the hot stock correctly in between the rolls and into a groove. An essential source of disturbance is thereby eliminated. At rolling with tension between the stands, the ends become coarser than at rolling without tension. In conventional blocks, therefore, very low tensions must be applied, whereby only the rolling is stabilized, but the process proper is not affected at all. With the short distances rendered possible by the invention, the thickened ends are very short, and with a roll pass design swallowing relatively great cross-section changes, for example the sequence flat-edging oval, the rolling can be carried out with relatively high tensions without appreciable disturbances.

Tension between the stands has been mentioned to be of essential effect on width increase. With moderate tension, thus, width increase can be prevented, and in each rolling stand a substantially greater reduction be made. As a result, the number of rolling stands required, and thereby also the investment and operation costs, can be reduced considerably.

The rolling stand design with two relatively large side plates taking up roll forces yields a very rigid structure, i.e. the resilience of the mill at a change of the roll force due to temperature or dimension variation of the ingoing hot stock is very small. The mill, therefore, is adapted for the rolling of products, for which narrow dimension tolerances are required.

It is, of course, possible to imagine a great number of rolling stand embodiments according to the invention without abandoning the invention idea.

The means for fastening the rolling stands on guide bars or the like can be designed in different ways, and they may, for example, be mechanic, hydraulic, pneumatic or electromagnetic.

At groove change, as mentioned, of course more than two fixed positions can be used when more grooves than two per roll are used.

The side plates and end members can be designed in several different ways. The movement of the wedges also can be arranged in several different ways, mechanically, electrically and hydraulically. Said movement can be controlled by an overlapping measuring and control system, so that the dimensions of the hot stock are measured on-line, for example only after the finishing rolling stand, and such that the roll gap automatically is adjusted in the different rolling stands, and the adjustment is made corresponding to desired final dimension. The movement of the wedges suitably takes place synchronously, so that a change of the roll gap substantially occurs without the central line of the roll gap in parallel with the axial direction of the rolls being changed.

The two-high rolling stands according to the invention have been described above with reference to the hot rolling of bars and wires. The rolling stands, however, due to their small dimensions in the rolling direction also very well adapted for rolling mills for cold rolling of, for example, bars and wires, rolling mills for compacting in connection with stranding and similar applications.

The invention, thus, must not be regarded be restricted to the embodiments described above, but can be varied within the scope of the attached claims.

I claim:

1. A two-high rolling stand for use in a plurality of stands constituting a rolling mill comprising a roll package having a pair of rolls with axial directions arranged in parallel, said roll package including bearing devices and housing therefor operable to support said rolls within said stand, end members arranged to exert force on said roll package, each of said end members having a roll gap adjustment means associated therewith for exerting force between said rolls, a pair of side plates arranged to contact said end members on either side thereof along a pair of planes parallel to the axial direction of said pair of rolls, said side plates releasably engaged with said end members and arranged to take up the roll forces exerted by said roll package, and said side plates having the main extension planes thereof substantially in parallel with a plane passing through the center lines of said pair of rolls.

2. A rolling stand according to claim 1, wherein said rolling stand seen in the rolling direction has a substantially square-like cross-section.

3. A rolling stand according to claim 1, wherein each of said side plates have opposing ends which include longitudinal boss members which are intended to face toward said end members and to abut said end members via flanges arranged along said end members, so that thereby roll forces arising during the rolling are transferred to the side plates via said end members and taken up by said side plates.

4. A rolling stand according to claim 3, wherein said longitudinal boss members are straight and extend substantially in parallel with the axial direction of the rolls and that said flanges arranged along the end members are straight in a corresponding manner.

5. A rolling stand according to claim 3, wherein said longitudinal boss members are curved in the form of an arc portion, in the main extension plane of said side plates, and that said flanges along said end members are curved in a corresponding manner.

6. A rolling stand according to claim 1, wherein said roll gap adjustment means comprises two wedges one each of which is located between each end member and said bearing device, said wedges being arranged to rest against said end member and said bearing device, and wherein each wedge is arranged to be moved substantially in parallel with the longitudinal direction of the rolls which movement gives rise to a well-defined change of the roll gap.

7. A rolling stand according to claim 6, wherein each of said wedges is formed so that the wedge surfaces thereof abut the end member and, respectively, the surfaces abutting the bearing device have plane surfaces.

8. A rolling stand according to claim 6, wherein each of said end members comprises a hydraulically operated cylinder, which is operable to bring about said movement of each of said wedges located in connection to said end members.

9. A rolling stand according to claim 7, wherein said plane surfaces of each of said wedges are intended to abut elevations on said bearing devices, said elevations being formed and arranged so that the load to be taken up by the elevations is distributed uniformly over each elevation and over the elevations relative to each other.

10. A rolling stand according to claim 6, wherein the movement of said wedges is intended to be carried out synchronously, and that an adjustment of the roll gap can take place substantially with no change of the position of the center line of the roll gap in parallel with the axial directions of the rolls.

11. A rolling stand according to claim 1, wherein said side plates comprise cooling means including cooling channels which permit the passage of water for cooling said side plates.

12. A rolling stand according to claim 1, wherein a first of the pair of side plates is located on the upstream side of said roll pair and wherein the second of said side plates is located on the downstream side of said roll pair.

13. A rolling stand according to claim 1, wherein said rolling stand has the pair of rolls spaced in a vertical direction and wherein the rolling stands on both sides thereof in said rolling mill have pairs of rolls spaced in the horizontal direction.

* * * * *